United States Patent [19]

Vera

[11] Patent Number: 4,871,298

[45] Date of Patent: Oct. 3, 1989

[54] FALCIFORM BLADE FOR A PROPELLER AND ITS APPLICATION IN PARTICULAR IN MOTORIZED FANS FOR AUTOMOBILES

[75] Inventor: Jean C. Vera, Valentigney, France

[73] Assignee: ECIA - Equipments Et Composants Pour L'Industrie Automoblie, Audincourt, France

[21] Appl. No.: 216,461

[22] Filed: Jul. 8, 1988

[30] Foreign Application Priority Data

Jul. 9, 1987 [FR] France ..... 87 09773

[51] Int. Cl.[4] ..... F04D 29/38

[52] U.S. Cl. ..... 416/189; 416/169 A

[58] Field of Search ..... 416/169 A, 189 R

[56] References Cited

U.S. PATENT DOCUMENTS

| | | | |
|---|---|---|---|
| 1,228,776 | 6/1917 | Hult | 416/189 R |
| 1,467,227 | 9/1923 | Capell | 416/189 R |
| 4,358,245 | 11/1982 | Gray | 416/189 R |
| 4,459,087 | 7/1984 | Barge | 416/189 R |
| 4,548,548 | 10/1985 | Gray | 416/189 R |
| 4,569,631 | 2/1986 | Gray | 416/189 R |
| 4,569,632 | 2/1986 | Gray | 416/189 R |
| 4,684,324 | 8/1987 | Perosino | 416/189 R |
| 4,685,513 | 8/1987 | Longhouse et al. | 416/189 R |

*Primary Examiner*—Everette A. Powell, Jr.

*Attorney, Agent, or Firm*—Sughrue, Mion, Zinn, Macpeak & Seas

[57] ABSTRACT

The blade (10) for a propeller constituted by a hub (20) to which the feet (12) are fixed has a leading edge (14) and a trailing edge (15) which is formed by two arcs (152, 153) having respective mean radii of curvature ($\rho 2$, $\rho 3$) which are different and interconnected without an angular point. These edges are both curved in the downstream direction and define a blade which narrows from the axis to the periphery of the propeller. Application in propellers of motorized fans associated with automobile vehicles.

7 Claims, 2 Drawing Sheets

FALCIFORM BLADE FOR A PROPELLER AND ITS APPLICATION IN PARTICULAR IN MOTORIZED FANS FOR AUTOMOBILES

BACKGROUND OF THE INVENTION

The present invention relates to blades for the propeller of motorized fans employed in particular in the automobile industry.

Propellers are used in many technical fields and in particular for fans. This is the case in the automobile industry in which motorized fans are associated with cooling radiators of heat engines.

As is known, each blade of a propeller, in particular of a motorized fan unit, produces a slip-stream which rotates at the speed of rotation of the propeller. This slip-stream generates a sound which is intense when it encounters a fixed obstacle. This is for example the case when the slip-stream encounters the arms of supports of a motorized fan unit which support the latter for maintaining it in a fixed position relative to the radiator with which it is associated.

Such axial fans produce a highly turbulent slip-stream which generates considerable noise. Indeed, when the slip-stream of a blade passes in front of a support arm, it produces a mechanical impulse which results in a particular noise which is added to the aerodynamic noise or to the noise of the driving motor.

The interest of reducing the noise produced by such a rotating slip-stream which passes in front of the support arms of the fan will of course be understood if a more silent operation is to be obtained.

The structure of the slip-stream produced by a blade is a function of the aerodynamic definition of the latter and in particular of the evolution of the range of speeds in the passage formed between two neighbouring blades. More specifically, it has been found that these slip-streams may create around the support arms non-stationary systems which are sources of noise if the gap between the trailing edges of the blades and the support arms is relatively small. It has been found that the slip-stream located in the extension of the trailing edges of the blades disappears relatively rapidly at a certain distance in the downstream direction from the trailing edge owing to the damping due to the viscosity of the air and that this slip-stream is then lost in the general turbulence of the flow.

Thus it can be seen that if it is possible to increase the distance between the trailing edge of such a propeller blade and the support arms supporting it without increasing the overall axial size of the assembly, the noise produced by the slip-stream when it encounters the fixing arms or the like may be reduced.

SUMMARY OF THE INVENTION

An object of the invention is to provide a propeller blade in particular of a motorized fan unit of use in the automobile, whose geometry imparts thereto at relatively high rotational regimes, high aerodynamic performances and a considerable level of silence.

To achieve this result, it is arranged that at least the preponderant section of the blade which generates acoustic noise be as far as possible from the fixed obstacles of the support arms or the like.

The invention therefore provides a blade for a propeller of in particular a fan of an automobile vehicle comprising a cylindrical central hub to which are fixed the feet of at least two blades, said blade having a leading edge and a trailing edge which are both curved and are arranged with respect to each other in such manner as to impart to the blade a falciform configuration, this falciform configuration narrowing from the foot toward the periphery, wherein the respective concavities of the curved leading edge and trailing edge face in the downstream direction relative to the direction of flow of the fluid, and the curved trailing edge is formed by two arcs whose respective mean radii of curvature are different and connected without an angular point.

Preferably, such a blade is intended for a propeller which comprises an outer cowling consisting of a peripheral sleeve to which the blade heads are fixed.

This type of blade is particularly suitable for propellers of motorized fans associated with radiators of automobile heat engines.

Further features of the invention will be apparent from the description and claims with reference to the accompanying drawing which is given solely by way of example and in which:

DETAILED DESCRIPTION OF A PREFERRED EMBODIMENT

As the propeller blades for motorized fans are well known in the art, there will only be described that which is related to the invention. For the rest of the structure, one skilled in the art will derive from conventional solutions available to him arrangements for solving specific problems he encounters.

It will be assumed hereinafter that the blade for the propeller according to the invention is adapted to be used for producing a propeller for a fan of a cooling radiator of automobile heat engines. However, it will be clear that such a blade which permits reducing the noise produced by its slip-stream when the latter encounters a fixed obstacle located at a short distance from its trailing edge and in the slip-stream of the latter, may be employed in other applications.

Figure 1:
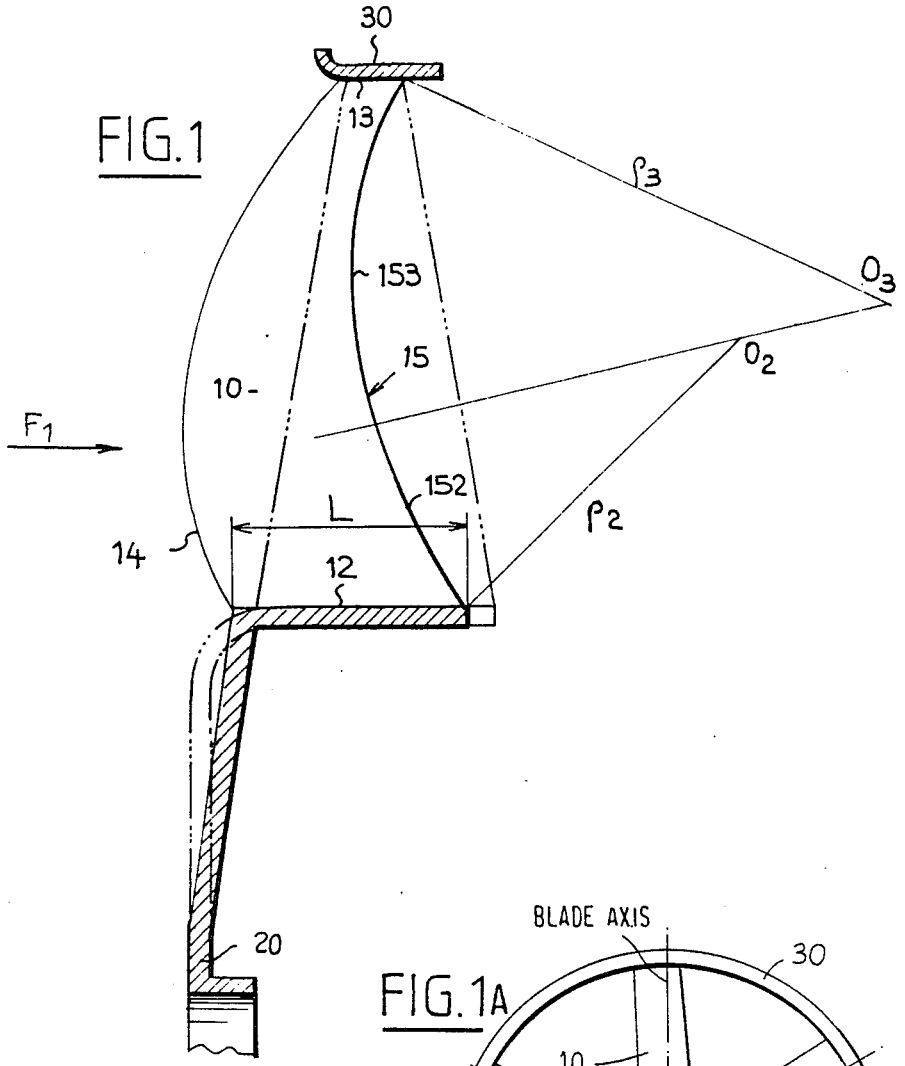
FIG. 1 is a partial diagrammatic axial meridian sectional view of a propeller blade according to the invention.
Figure 1A:
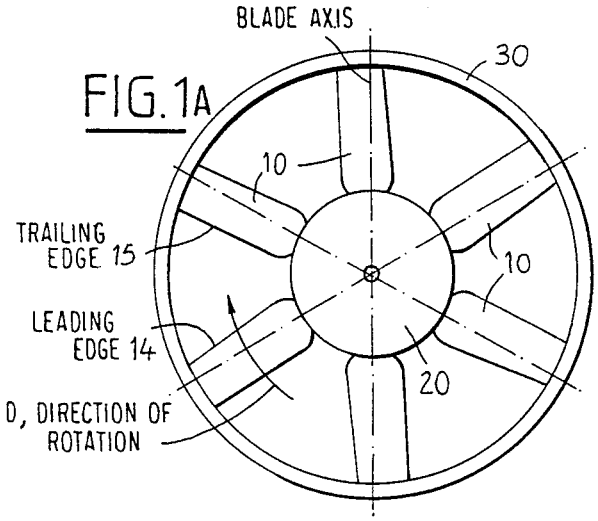
FIG. 1A is a front plan view of a propeller embodying the blade of FIG. 1.

As can be seen in FIG. 1 and 1A, a blade 10 is part of a propeller comprising a central hub 20 and a peripheral sleeve 30. The feet 12 and the heads 13 of the blades are fixed to the hub and sleeve respectively.

The blade 10 has a leading edge 14 and a trailing edge 15. Support arms or the like adapted to support the motorized fan are not shown.

As can be seen in the figures, the leading edge 14 and the trailing edge 15 are both curved and are so arranged relative to each other as to impart a falciform or sickle-shaped configuration which narrows from the foot to the head of the blade. As can be seen in the drawing, the respective concavities of the leading edge 14 and trailing edge 15 face in the downstream direction with respect to the direction of flow of the fluid, as diagrammatically represented by the arrow F, when the propeller rotates in a direciton diagrammatically represented by arrow D. The blade axes (in a diametral plane) are represented by dot-dash lines in FIG. 1A.

Note that the trailing edge 15 is formed by two arcs 152, 153 whose respective mean radii of curvature $\rho_2$ and $\rho_3$ are different and are connected without an angular point. These arcs of a curvature 152 and 153 are arcs of a circle or arcs of a cone having for example centres $O_2$ and $O_3$ respectively.

In order to achieve the maximum reduction of the noise without loss of efficiency relative to a conventional propeller it has been found that the mean radius of curvature $\rho 2$ of the arc 152 located adjacent to the foot 12 of the blade must be smaller than the mean radius of curvature $\rho 3$ of the arc 153 located adjacent to head 13 of the blade. Preferably, this radius $\rho 2$ of the arc 152 is approximately between about one quarter and one third of the outside diameter of the hub 20 measured at the foot of the blade.

For example, for a hub 20 whose axial length or thickness is on the order of 55 mm, there is adopted for the radius $\rho 2$ of the arc 152 located adjacent to the blade foot 12, a value approximately between one quarter and one third of the diameter of the sleeve 30 measured at the head of the blade. For an axial length of the hub 20 which does not exceed 38 mm there is chosen for the radius $\rho 2$ a value equal to about one half of this diameter of the sleeve.

This especially concerns the median sections of the blade which produce the most energy from the point of view of acoustic emission. These sections occupy approximately a zone which is roughly equally distributed between the foot and the head of the blade and extends over about three quarters of the latter.

According to the invention, the falciform configuration of the blade is such that the ratio between the lengths of the blade feet 12 and blade heads 13 respectively is on the order of about 0.4.

The indicated dimensions are orders of magnitude. For example, as noticed, the mean radius of curvature $\rho 3$ of the arc 153 located adjacent to the blade head 13 is a function of the axial length L of the hub 20.

In order to illustrate the improvement afforded by a propeller blade according to the invention, its sound characteristics are compared with those of a conventional blade diagrammatically illustrated in FIG. 1 in dot-dash lines.

These blades according to the invention and according to the prior art have geometries calculated in accordance with conventional techniques in such a manner as to have similar aerodynamic performances as concerns the flows and static pressure. Only the profiles of the curved leading and trailing edges according to the invention and rectilinear leading and trailing edges according to the prior art change.

For example, these propellers produce a flow of 1700 cu. m/h with a static pressure of 15 mm of a water head when the diameter of the blade head is 305 mm and the diameter of the blade foot 124 mm and when the conventional propeller is rotated at 2580 rpm and the propeller according to the invention is rotated at 2650 rpm. These two propellers are associated with the same motor and the same vehicle radiator by means of support arms which have the same configuration.

Figure 2A:
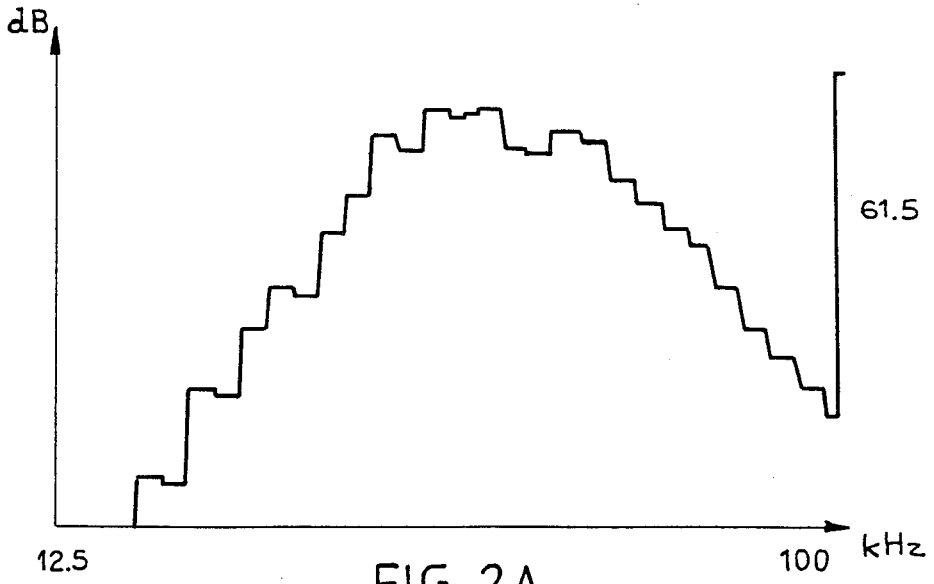
FIGS. 2A and 2B respectively illustrate the noise produced by a propeller according to the invention and the noise produced by a propeller of the prior art, the characteristics of speed and flow and the dimensions of which are substantially the same.
Figure 2B:
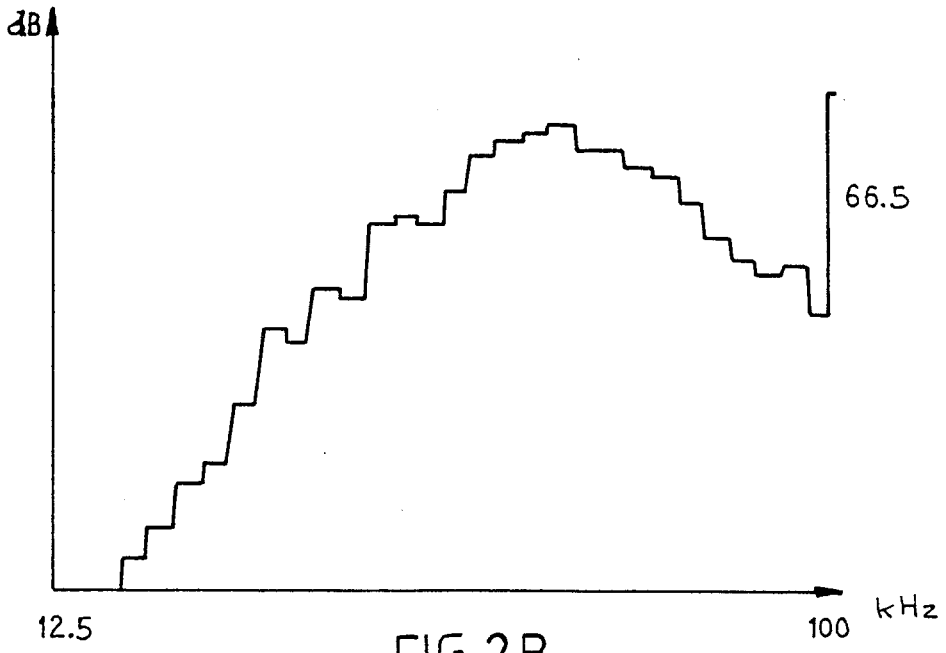

The performances of these two propellers are respectively illustrated in FIG. 2A in respect of the propeller according to the invention and FIG. 2B in respect of a conventional propeller. In these graphs, the sound frequencies in kHz are plotted as abscissae and the sound level in dB are plotted as ordinates. The reduction in the overall sound level for a propeller according to the invention is immediately obvious, since this level is 61.5 dB whereas it is 66.5 dB for a conventional propeller.

In FIG. 2, the acoustic pressure levels are analysed as thirds of an octave and the level of the overall noise is shown weighted in accordance with the standard A.

It can also be seen that the maximum is reached at a lower frequency with a blade according to the invention.

Owing to the invention, it was possible to increase the axial distance between the trailing edge of the blade of the propeller and the fixed obstacles formed by the support arms of the motorized fan or the like which produce noise. The invention results in a relatively low sound level by the displacement of the frequency spectrum of the acoustic energy in the direction of the frequencies which correspond to less sensitivity on the part of the human ear.

What is claimed is:

1. A propeller for a fan for an automobile vehicle, said propeller being rotatable about an axis and comprising a peripheral outer part in the form of a sleeve (30), a central hub (20), at least one blade (10) having a foot (12) connected to said hub (20), a head (13) connected to said sleeve (30) and leading (14) and trailing (15) edges which are both curved and arranged relative to each other in such a manner as to impart to the blade a falciform configuration which narrows from said foot to said head in a direction parallel to said axis, wherein the lengths of said foot and head measured in said direction parallel to said axis are in a ratio on the order of 0.4, wherein respective concavities of the curved leading and trailing edges face in a downstream direction with respect to a direction of a fluid flow through the propeller, and wherein the trailing edge (15) is formed by two arcs (152, 153) which have different respective radii ($p_2$, $p_3$) and which are interconnected without an angular point.

2. A blade according to claim 1, wherein at least one of said arcs is an arc of a circle.

3. A blade according to claim 1, wherein at least one of said arcs is an arc of a cone.

4. A blade according to claim 1, wherein the mean radius of curvature of the arc located adjacent to the blade foot is smaller than the mean radius of curvature of the arc located adjacent to the blade head.

5. A blade according to claim 1, wherein said hub is cylindrical, and the mean radius of curvature of the arc located adjacent to the blade foot is between approximately about one quarter and about one third of the diameter of said hub.

6. A blade according to claim 1, wherein said hub is cylindrical, and the mean radius of curvature of the arc located adjacent to the blade head is a function of the axial length of said hub.

7. A propeller for a motorized fan for cooling an automobile radiator, said propeller comprising a central hub and an outer peripheral part in the form of a sleeve, and a plurality of blades interposed between said hub and peripheral part, each blade comprising a foot connected to said hub and a head connected to said peripheral outer part, each blade having a leading edge and a trailing edge which are both curved and which are arranged relative to each other in such manner as to impart to the blade a falciform configuration which narrows from said foot to said head, respective concavities of the curved leading and trailing edges facing in a downstream direction with respect to a direction of flow of fluid through the propeller, and the trailing edge being formed by two arcs having respective radii of curvature which are different and which are interconnected without an angular point.

* * * * *